US011653755B2

(12) United States Patent
Guo

(10) Patent No.: US 11,653,755 B2
(45) Date of Patent: May 23, 2023

(54) TELESCOPIC BASKET WITH STEPLESSLY-ADJUSTABLE WIDTH

(71) Applicant: Intradin Huzhou Hardware Co., Ltd., Huzhou (CN)

(72) Inventor: Shulai Guo, Huzhou (CN)

(73) Assignee: Intradin Huzhou Hardware Co., Ltd., Huzhou (CN)

( * ) Notice: Subject to any disclaimer, the term of this patent is extended or adjusted under 35 U.S.C. 154(b) by 0 days.

(21) Appl. No.: 17/539,553

(22) Filed: Dec. 1, 2021

(65) Prior Publication Data

US 2022/0087415 A1 Mar. 24, 2022

(30) Foreign Application Priority Data

Feb. 26, 2021 (CN) ..... 202120423487.X

(51) Int. Cl.

| | |
|---|---|
| ***A47B 45/00*** | (2006.01) |
| ***A47B 88/994*** | (2017.01) |
| ***A47F 5/00*** | (2006.01) |
| ***A47B 88/90*** | (2017.01) |
| ***A47B 88/423*** | (2017.01) |
| *A47B 88/40* | (2017.01) |

(52) U.S. Cl.

CPC ..... *A47B 45/00* (2013.01); *A47B 88/423* (2017.01); *A47B 88/941* (2017.01); *A47B 88/994* (2017.01); *A47F 5/0093* (2013.01); *A47B 2088/401* (2017.01); *A47B 2210/04* (2013.01)

(58) Field of Classification Search

CPC .... A47L 15/501; A47L 15/503; A47L 15/507; A47F 5/13; A47F 5/0093; A47B 45/00; A47B 88/423; A47B 2088/401; A47B 2210/04; A47B 88/407; A47B 88/913; A47B 88/9412; A47B 88/941; A47B 88/994

USPC ..... 211/41.4, 126.15, 175, 181.1, 133.5, 211/126.6, 88.02, 126.9; 312/348.3

See application file for complete search history.

(56) References Cited

U.S. PATENT DOCUMENTS

| | | | | | |
|---|---|---|---|---|---|
| 1,925,371 | A * | 9/1933 | Charter | F25D 25/02 | 126/339 |
| 1,997,432 | A * | 4/1935 | Replogle | F25D 25/02 | 126/339 |
| 4,267,931 | A * | 5/1981 | Belotta | A47B 45/00 | 211/153 |
| 4,553,523 | A * | 11/1985 | Stohrer, Jr. | A47J 37/0694 | 99/449 |
| D291,646 | S * | 9/1987 | Koziol | D7/409 | |
| 4,913,298 | A * | 4/1990 | Compagnucci | A47B 77/16 | 211/94.01 |

(Continued)

FOREIGN PATENT DOCUMENTS

CN 203058954 U 7/2013

*Primary Examiner* — Jennifer E. Novosad

(57) ABSTRACT

A telescopic basket with steplessly-adjustable width includes a basket main body, a fixing part, and a connecting part. The basket main body includes two sets of basket frames and a basket bottom. The two sets of basket frames are arranged opposite to each other. The basket bottom includes two sets of nets. The two sets of nets are telescopically and staggeredly with each other. The two sets of basket frames are telescopically connected to the two sets of nets through the fixing part and the connecting part, respectively.

9 Claims, 6 Drawing Sheets

(56) References Cited

U.S. PATENT DOCUMENTS 5,384,937 A * 1/1995 Simon ..... H02G 3/0443 24/295
6,422,405 B1 * 7/2002 Haenszel ..... B65D 85/68 211/208
6,491,173 B1 * 12/2002 Costa ..... A47B 88/427 211/126.15
6,590,154 B1 * 7/2003 Badey ..... H02G 3/0443 174/480
7,182,210 B2 * 2/2007 Metcalf ..... A47B 96/025 211/90.03
7,448,508 B2 * 11/2008 Babucke ..... F24C 15/16 211/126.9
7,571,822 B2 * 8/2009 Metcalf ..... A47B 96/025 211/90.03
7,810,890 B2 * 10/2010 Klein ..... A47B 88/483 312/334.32
8,540,090 B2 * 9/2013 Caveney ..... H02G 3/0443 248/68.1
8,573,416 B2 * 11/2013 Didehvar ..... A47K 3/281 211/119.009
9,468,293 B2 * 10/2016 Yang ..... A47B 96/025
9,516,990 B2 * 12/2016 Graute ..... A47L 15/504
9,596,931 B1 * 3/2017 Nimgulkar ..... A47B 88/49
9,642,457 B1 * 5/2017 Halfen ..... A47F 7/143
10,034,557 B1 * 7/2018 Nagel ..... A47F 5/0025
10,084,294 B2 * 9/2018 Bethoule ..... H02G 3/0437
10,602,910 B2 * 3/2020 Gutkowski ..... A47L 15/506
10,736,438 B1 * 8/2020 Jhaveri ..... A47B 47/00
11,044,993 B2 * 6/2021 Chiao ..... A47B 55/02
11,229,302 B2 * 1/2022 Ciesick ..... A47F 1/126
2006/0201899 A1 * 9/2006 Lin ..... A47B 88/40 211/183
2008/0258593 A1 * 10/2008 Berger ..... A47B 88/994 312/348.3
2008/0314846 A1 * 12/2008 Klein ..... A47J 47/16 211/41.11
2014/0197121 A1 * 7/2014 Knight ..... A47B 88/994 29/428
2021/0259438 A1 * 8/2021 Oody ..... A47F 5/13
2022/0087415 A1 * 3/2022 Guo ..... A47G 23/06

* cited by examiner

TELESCOPIC BASKET WITH STEPLESSLY-ADJUSTABLE WIDTH

CROSS-REFERENCE TO RELATED APPLICATIONS

This application claims the benefit of priority from Chinese Patent Application No. 202120423487.X, filed on Feb. 26, 2021. The content of the aforementioned application, including any intervening amendments thereto, is incorporated herein by reference in its entirety.

TECHNICAL FIELD

This application relates to storage basket, in particular to a telescopic basket with steplessly-adjustable width.

BACKGROUND

At present, storage baskets used in cabinets generally have an integrated fixed structure. In order to fit cabinets of different sizes, storage baskets need to be processed into multiple models, which bring large demand for storage location. Moreover, the relatively large packaging size leads to high transportation cost. Chinese patent application No. 201220727127.X, titled "Adjustable telescopic double-layer basket", discloses an adjustable telescopic double-layer basket, in which the left basket and the right basket are telescopically connected through a plastic fixing part and a plastic connecting part. When the left and right baskets are expanded, the wires at the front and rear ends of the left and right baskets are respectively clamped into the outer slot of the plastic fixing part on the front and rear ends of the left and right baskets, and are fixed with a flat-head screw through the plastic connecting part. When the left and right baskets are contracted, the wires at the front and rear ends of the left and right baskets are respectively clamped into the middle slot of the plastic fixing part, and are fixed with the flat-head screw through the plastic connecting part. A regulating block is arranged between the left and the right baskets to realize the expansion and contraction to render the basket adaptable to cabinets with various widths. However, the connection between the left basket and the right basket is only dependent on the plastic fixing part and the plastic connecting part, failing to ensure the stable connection. Moreover, the iron wires at the bottom of the left and right baskets are arranged longitudinally, and are just stacked at the bottom, so that when the bottoms of the left and right baskets overlap incompletely during the expansion and contraction, the bottom of the entire basket is uneven. At the same time, the left and right baskets are not connected at the bottom, resulting in insufficient firmness of the bottom, which will be not conducive to the placement of items. Therefore, the existing telescopic baskets urgently need to be improved and developed.

SUMMARY

An object of this disclosure is to provide a telescopic basket with a steplessly-adjustable width to solve the problems of uneven bottom and insufficient connection firmness in the existing telescopic baskets.

The technical solutions of this disclosure are described as follows.

The present disclosure provides a telescopic basket with a steplessly-adjustable width, comprising:

a basket main body;

a fixing part; and a connecting part;

wherein the basket main body comprises two sets of basket frames and a basket bottom; the two sets of basket frames are arranged opposite to each other; the basket bottom comprises two sets of nets; the two sets of nets are telescopically and staggeredly with each other; and the two sets of basket frames are telescopically connected to the two sets of nets through the fixing part and the connecting part, respectively.

In an embodiment, the two sets of basket frames are symmetrical along a transverse direction; a bottom of two ends of each of the two sets of basket frames is provided with a guiding iron wire; a middle of two ends of each of the two sets of basket frames is provided with a positioning frame line; a bottom of the connecting part is provided with a first slot configured to fit the guiding iron wire; a middle of the connecting part is provided with a plurality of second slots configured to fit the positioning frame line; a telescopic regulation is enabled by clamping the positioning frame line from one of the plurality of the second slots into another of the plurality of the second slots; and the positioning frame line is fixed in one of the plurality of second slots by the fixing part.

In an embodiment, one of the two sets of nets comprises a plurality of first net iron wires, a first fixing iron wire and a first moving iron wire; the other of the two sets of nets comprises a plurality of second net iron wires, a second fixing iron wire and a second moving iron wire; the plurality of first net iron wires are arranged in parallel along a transverse direction and in an aligned manner; the plurality of second net iron wires are arranged in parallel along a transverse direction and in an aligned manner;

one end of each of the plurality of first net iron wires is connected to the first fixing iron wire, and the other end of each of the plurality of first net iron wires is connected to the first moving iron wire; one end of each of the plurality of second net iron wires is connected to the second fixing iron wire, and the other end of each of the plurality of second net iron wires is connected to the second moving iron wire;

the plurality of first net iron wires and the plurality of second net iron wires are staggeredly arranged;

the first moving iron wire is provided with a plurality of first recesses, and the plurality of first recesses respectively fit the plurality of second net iron wires to allow the plurality of second net iron wires to pass through the first moving iron wire to be connected with the second moving iron wire; the second moving iron wire is provided with a plurality of second recesses, and the plurality of second recesses respectively fit the plurality of first net iron wires to allow the plurality of first net iron wires to pass through the second moving iron wire to be connected with the first moving iron wire.

In an embodiment, the telescopic basket further comprises a first flat-head screw and a second flat-head screw; two ends of the first fixing iron wire are connected to one of the two sets of basket frames respectively through the first flat screw; two ends of the second fixing iron wire are connected to the other of the two sets of basket frames respectively through the second flat screw; the fixing part is provided with a third slot configured to fit the first slot; an end of the first moving iron wire passes through the third slot to be connected with an end of the guiding iron wire, and is arranged in the first slot; and an end of the second moving iron wire passes through the third slot to be connected with the end of the guiding iron wire, and is arranged in the first slot.

In an embodiment, when the basket main body is extended, the positioning frame line of each of the two sets of basket frames is clamped into second slots at an outer side of the connecting part; the guiding iron wire of each of the two sets of basket frames is arranged in the first slot of the connecting part.

In an embodiment, when the basket main body is contracted, the positioning frame line of each of the two sets of basket frames is clamped into second slots at a middle of the connecting part; the guiding iron wire of each of the two sets of basket frames is arranged in the first slot of the connecting part.

In an embodiment, two sides of the basket main body are respectively provided with a hook style slide for installation.

In an embodiment, each of the two sets of nets is provided with a first operating part; the hook style slide is provided with a second operating part; and the first operating part is connected with the second operating part.

In an embodiment, the connecting part and the fixing part are both made of a plastic.

Compared with the prior art, this disclosure has the following beneficial effects.

In the telescopic basket with steplessly-adjustable width of the present disclosure, the basket bottom includes two sets of nets which are in a telescopic and staggered connection, so that the basket bottom remains even during the extension and contraction and the reliable connection is enabled. Moreover, the basket of the disclosure has reasonable structure, convenient use and simple operation, and is suitable for cabinets with different widths. The basket can be combined into a double-layer basket or a multi-layer basket according to the actual needs, allowing for high installation flexibility.

2. basket frame; 2. net; 3. fixing part; 4. connecting part; 5. third flat-head screw; 6. hook style slide; 81. first flat-head screw; 82. second flat-head screw; 9. self-tapping screw; 11. positioning frame line; 12. guiding iron wire; 211. first net iron wire; 212. second net iron wire; 221. first fixing iron wire; 222. second fixing iron wire; 231. first moving iron wire; 232. second moving iron wire; 31. third slot; 41. second slot; 42. first slot; 51. first operating part; and 52. second operating part.

DETAILED DESCRIPTION OF EMBODIMENTS

This disclosure will be described in detail below with reference to the accompanying drawings and embodiments.

Figure 1:
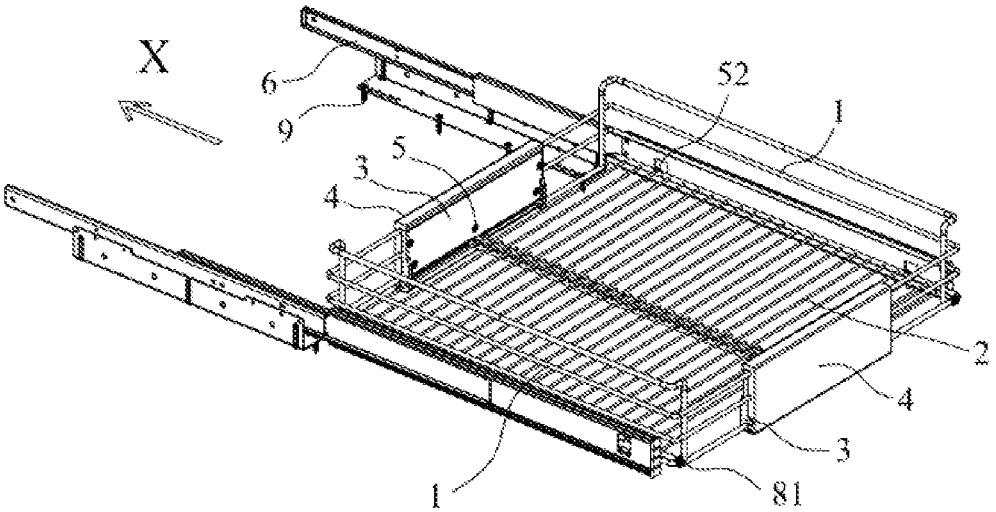
FIG. 1 is a schematic diagram of a telescopic basket with steplessly-adjustable width according to an embodiment of the disclosure.

FIG. 1 is a schematic diagram of the telescopic basket with steplessly-adjustable width.

Referring to an embodiment shown in FIG. 1, a telescopic basket with steplessly-adjustable width of this disclosure includes a basket main body, a fixing part 3, and a connecting part 4. The basket main body includes two sets of basket frames 1 and a basket bottom. The two sets of basket frames 1 are arranged opposite to each other. The basket bottom includes two sets of nets 2 that are in a telescopic and staggered connection. The two sets of basket frames 1 and the two sets of nets 2 are correspondingly connected by the fixing part 3 and the connecting part 4. Specifically, one of the two sets of basket frames 1 is connected with the corresponding set of net 2 to form a first intermediate structure, and the other of the two sets of basket frames 1 is connected with the corresponding set of net 2 to form a second intermediate structure, where the first intermediate structure and the second intermediate structure are the same in structure. The first intermediate structure and the second intermediate structure are telescopically connected by the fixing part 3 and the connecting part 4.

In an embodiment, two sides of the basket main body are respectively provided with a hook style slide 6 for installation.

In an embodiment, each of the two sets of nets 2 is provided with a first operating part 51, and the hook style slide 6 is provided with a second operating part 52. The first operating part 51 and the second operating part 52 are connected. Specifically, the first operating part 51 and the second operating part 52 are provided in plural. The first operating part 51 and the second operating part 52 can enhance the structural strength and play a role in positioning. In an embodiment, the first operating part 51 is a U-shaped buckle, and the second operating part 52 is a hook.

Figure 2:
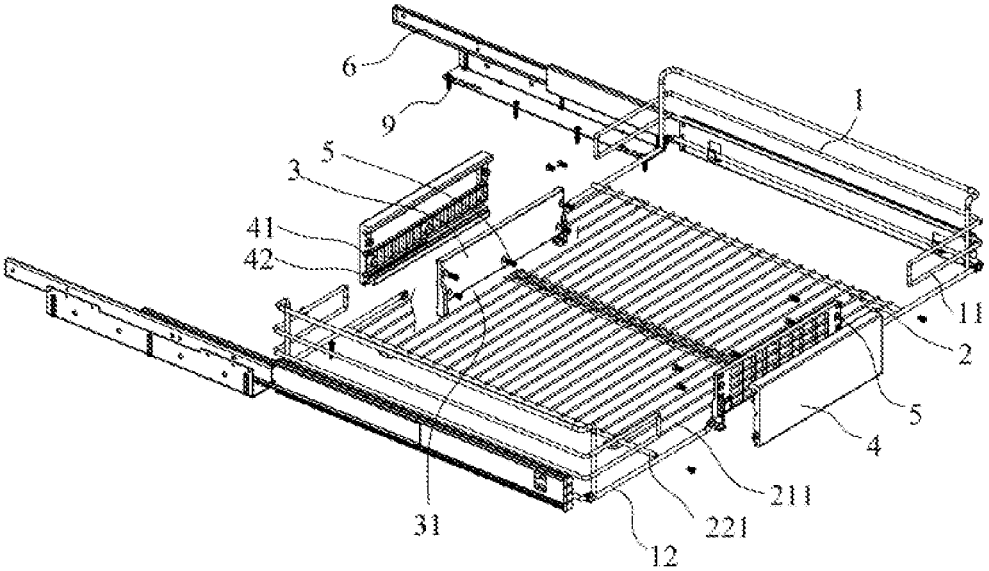
FIG. 2 is an exploded view of the telescopic basket according to an embodiment of the disclosure.

Referring to an embodiment shown in FIG. 2, the two sets of basket frames 1 have a symmetrical structure along a transverse direction. A bottom of two ends of each of the two sets of basket frames 1 is provided with a guiding iron wire 12, and a middle portion and an upper portion of two ends of each of the two sets of basket frames 1 is provided with a positioning frame line 11. A bottom of the connecting part 4 is provided with a first slot 42 configured to fit a guiding iron wire. A middle of the connecting part 4 is provided with a plurality of second slots 41 configured to fit the positioning frame line 11. A telescopic regulation is enabled by regulating a position where the positioning frame line 11 is clamped into the plurality of the second slots 41, and the positioning frame line 11 is fixed in the plurality of second slots 41 by the fixing part 3. Specifically, the transverse direction is referred to the X-axis direction shown in FIG. 1.

Figure 7:
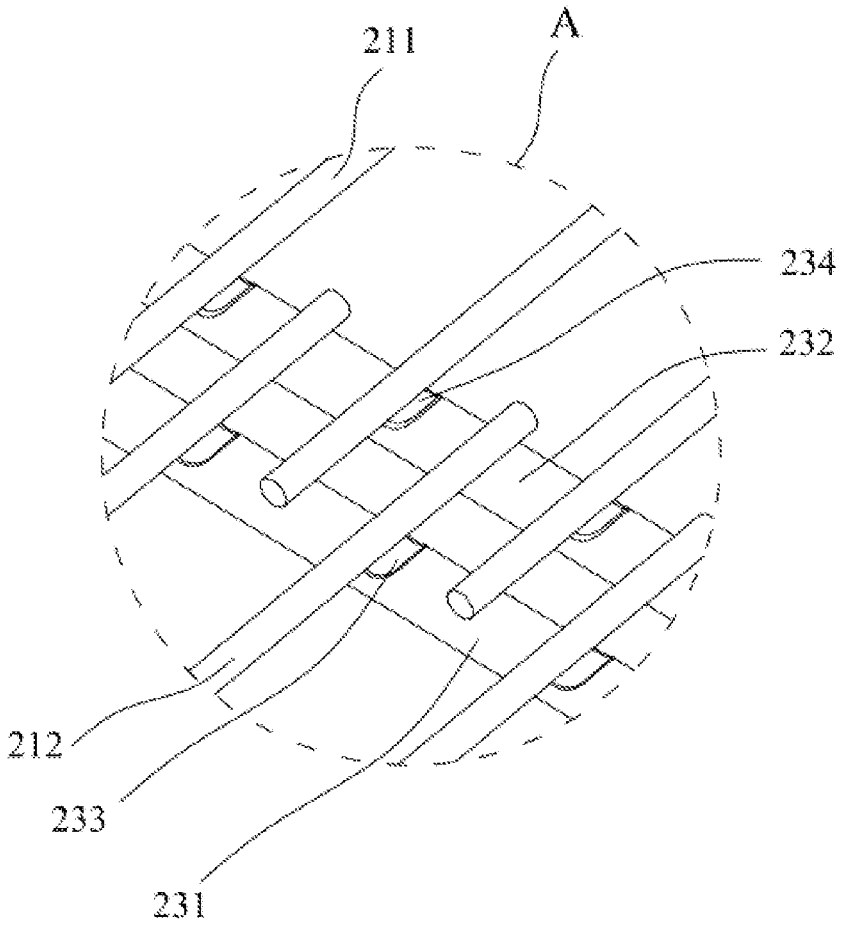
FIG. 7 is a close-up view of part A in FIG. 3.

Specifically, referring to FIG. 7, one of the two sets of nets 2 includes a plurality of first net iron wires 211, a first fixing iron wire 221 and a first moving iron wire 231, and the first net iron wires 211 are arranged in parallel along the transverse direction and in an aligned manner. The other of the two sets of nets 2 includes a plurality of second net iron wires 212, a second fixing iron wire 222 and a second moving iron wire 232, and the second net iron wires 212 are arranged in parallel along the transverse direction and in an aligned manner. Specifically, the transverse direction is referred to the X-axis direction shown in FIG. 1. One end of each of the plurality of first net iron wires 211 is connected to the first fixing iron wire 221, and the other end of each of the plurality of first net iron wires 211 is connected to the first moving iron wire 231. One end of each of the plurality of second net iron wires 212 is connected to the second fixing iron wire 222, and the other end of each of the plurality of second net iron wires 212 is connected to the second moving iron wire 232. The plurality of first net iron wires 211 and the plurality of second net iron wires 212 are staggeredly arranged. The first moving iron wire 231 is provided with a plurality of first recesses 233, and the plurality of first recesses 233 respectively fit the plurality of second net iron wires 212 to allow the plurality of second net iron wires 212 to pass through the first moving iron wire 231 to be connected with the second moving iron wire 232. The second moving iron wire 232 is provided with a plurality of second recesses 234, and the plurality of second recesses 234 respectively fit the plurality of first net iron wires 211 to allow the plurality of first net iron wires 211 to pass through the second moving iron wire 232 to be connected with the first moving iron wire 231. Based on the arrangement of the plurality of first recesses 233 and second recesses 234, the two sets of nets 2 can be always kept on the same horizontal plane during the extension and contraction. Two ends of the first fixing iron wire 221 are connected to one of the two sets of basket frames 1 respectively through a first flat screw 81. Two ends of the second fixing iron wire 222 are connected to the other of the two sets of basket frames 1 respectively through a second flat screw 82. The fixing part 3 is provided with a third slot 31 configured to fit the first slot 42. An end of the first moving iron wire 231 passes through the third slot 31 to be connected with an end of the guiding iron wire 12, and is arranged in the first slot 42. An end of the second moving iron wire 232 passes through the third slot 31 to be connected with the end of the guiding iron wire 12, and is arranged in the first slot 42.

Although the first net iron wires 211 and the second net iron wires 212 can also be arranged longitudinally, the longitudinal arrangement fails to enable the staggered connection between the two sets of nets 2. Moreover, when the two sets of nets 2 partially overlap during the contraction, the bottom is still uneven. The fixing part 3 needs to be disassembled and assembled to realize the extension and contraction, which leads to complex operation. Therefore, the transverse arrangement and staggered connection of the first net iron wires 211 and the second net iron wires 212 can ensure that the two sets of nets are located on the same horizontal plane. During the regulation process, it is only required to loosen a third flat-head screw 5 which is used for locking the fixing part 3, such that the fixing part 3 does not abut against the guiding iron wire 12, enabling the guiding iron wire 12 and ends of the first moving iron wire 231 and the second moving iron wire 232 to slide in the first slot 42 of the connecting part 4 to complete the extension or contraction. After the desired width is reached, the third flat-head screw 5 is tightened to allow the fixing part 3 to abut against the guiding iron wire 12 to complete the regulation, allowing for simple operation.

Figure 3:
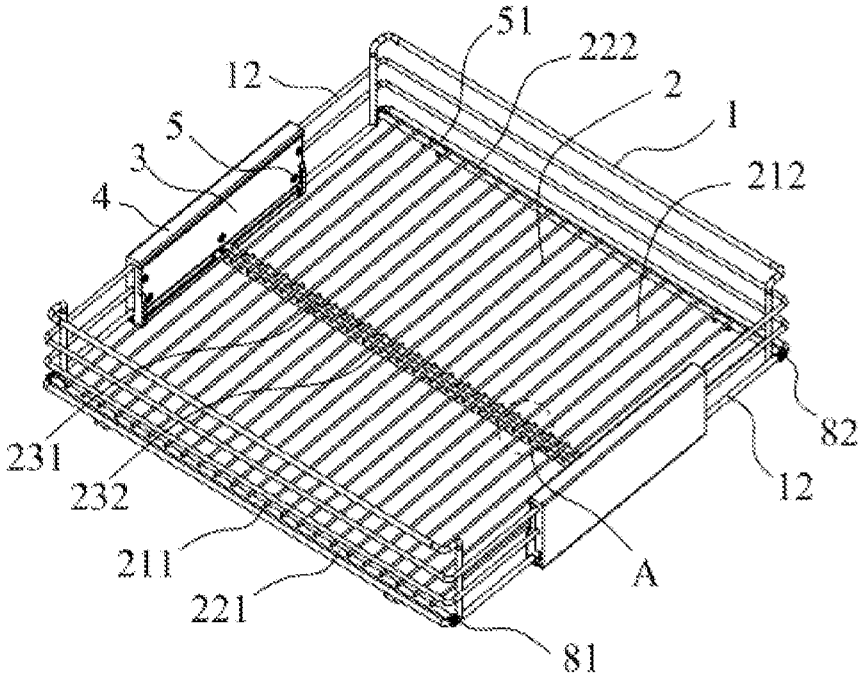
FIG. 3 is a schematic diagram of the telescopic basket according to an embodiment of the disclosure when it is extended to the maximum size in use.

Referring to FIG. 3, when the basket main body is extended, the positioning frame line 11 of each of the two sets of basket frames 1 is clamped into second slots 41 at an outer side of the connecting part 4. The guiding iron wire 12 of each of the two sets of basket frames 1 is arranged in the first slot 42 of the connecting part 4. The end of the first moving iron wire 231 and the end of the second moving iron wire 232 are connected with the guiding iron wire 12 and is arranged in the first slot 42. The fixing part 3 is fixed on the connecting part 4 through the third flat-head screw 5.

Figure 4:
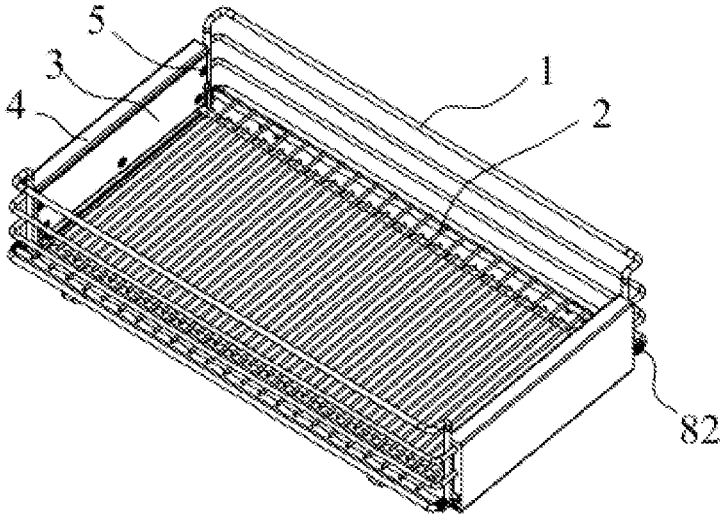
FIG. 4 is a schematic diagram of the telescopic basket according to an embodiment of the disclosure when it is contracted the a minimum size.
Figure 5:
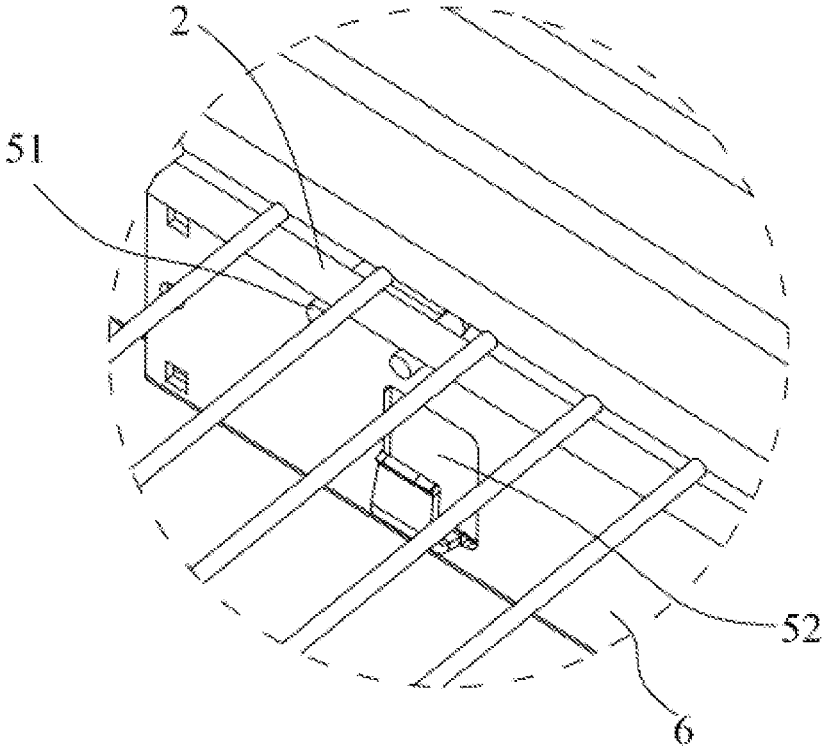
FIG. 5 is a schematic diagram of a first operating part and a second operating part in an unconnected state.
Figure 6:
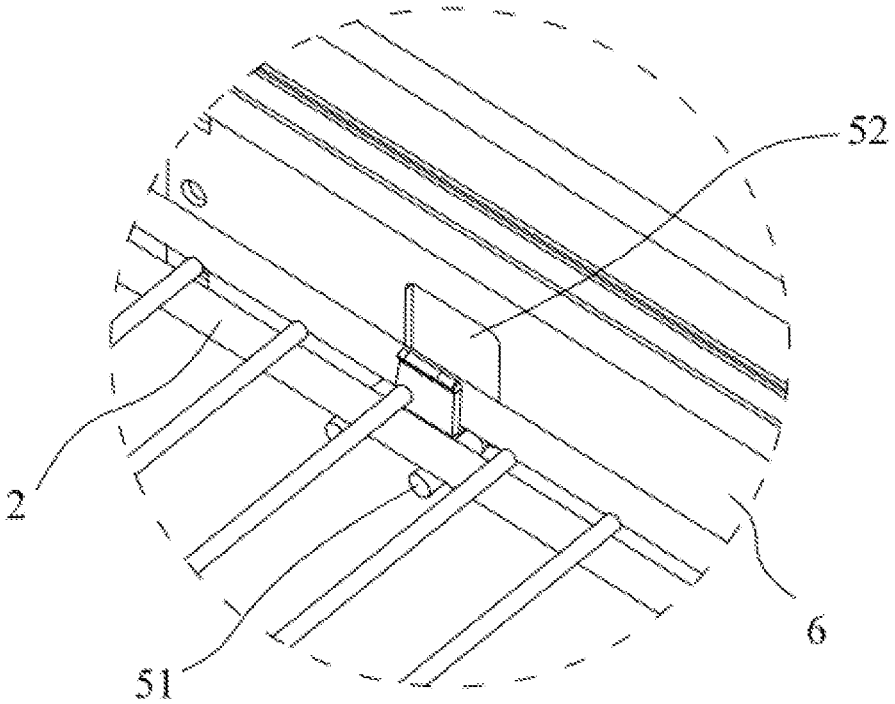
FIG. 6 schematically illustrates connection between the first operating part and the second operating part.

Referring to FIG. 4, when the basket main body is contracted, the positioning frame line 11 of each of the two sets of basket frames 1 is clamped into the second slots 41 at the middle of the connecting part 4. The guiding iron wire 12 of each of the two sets of basket frames 1 is arranged in the first slot 42 of the connecting part 4. The end of the first moving iron wire 231 and the end of the second moving iron wire 232 are connected to the guiding iron wire 12 and is arranged in the first slot 42. The fixing part 3 is fixed on the connecting part 4 through the third flat-head screw 5.

In an embodiment, the connecting part 4 and the fixing part 3 are made of a plastic, which facilitates simplifying the manufacturing process and lowering the cost.

In an embodiment, two sides of the basket main body are provided with additional connecting parts to be combined into a double-layer basket or a multi-layer basket.

During the installation of the telescopic basket of this embodiment, the first flat-head screw 81 is used to connect the first fixing iron wire 221 with the corresponding basket frame 1 and the second flat-head screw 82 is used to connect the second fixing iron wire 222 with the corresponding basket frame 1. Then the first flat-head screw 81 is used to connect the guiding iron wire 12 with the first moving iron wire 231 and the second flat-head screw 82 is used to connect the guiding iron wire 12 with the second moving iron wire 232 to form the basket main body. The third flat-head screw 5 and the fixing part 3 are loosened, which makes the guiding iron wire 12 and ends of the first moving iron wire 231 and the second moving iron wire 232 slidable in the first slot 42 of the connecting part 4. The positioning frame line 11 of each of the two sets of basket frames 1 is clamped into the second slot 41 at the appropriate position to make the width of the basket suitable for the width of the cabinet. The third flat-head screw 5 is tightened to make the connecting part 4 and the fixing part 3 clamp the positioning frame line 11 and the guiding iron wire 12, completing the extension or contraction of the telescopic basket. Then, the hook style slide 6 is fixed on the sidewall of the cabinet by a self-tapping screw 9, and each of the two sets of basket frames 1 is clamped into the hook style slide 6, to complete the installation of the telescopic basket on the cabinet.

In summary, with respect to the telescopic basket with steplessly-adjustable width of this embodiment, the two sets of nets 2 are in a telescopic and staggered connection, which makes the basket bottom remain even and reliable during the telescopic regulation. Moreover, the basket has reasonable structure, convenient use and simple operation, and is suitable for cabinets with different widths. The basket can be combined into a double-layer basket or a multi-layer basket, which is more flexible in installation and use.

Described above are preferred embodiments of this disclosure, which are not intended to limit the scope of this disclosure. Any modifications and improvements made by those of ordinary skill in the art without departing from the spirit of the application should fall within the scope of the disclosure defined by the appended claims.

What is claimed is:

1. A telescopic basket with steplessly-adjustable width, comprising:

a basket main body;

a fixing part; and a connecting part;

wherein the basket main body comprises two sets of basket frames and a basket bottom; the two sets of basket frames are arranged opposite to each other; the basket bottom comprises two sets of nets; the two sets of nets are telescopically and staggeredly connected with each other; and the two sets of basket frames are telescopically connected to the two sets of nets through the fixing part and the connecting part, respectively.

2. The telescopic basket of claim 1, wherein the two sets of basket frames are symmetrical along a transverse direction; a bottom of two ends of each of the two sets of basket frames is provided with a guiding iron wire; a middle of two ends of each of the two sets of basket frames is provided with a positioning frame line; a bottom of the connecting part is provided with a first slot configured to fit the guiding iron wire; a middle of the connecting part is provided with a plurality of second slots configured to fit the positioning frame line; a telescopic regulation is enabled by clamping the positioning frame line from one of the plurality of the second slots into another of the plurality of the second slots; and the positioning frame line is fixed in one of the plurality of second slots by the fixing part.

3. The telescopic basket of claim 2, wherein one of the two sets of nets comprises a plurality of first net iron wires, a first fixing iron wire and a first moving iron wire; the other of the two sets of nets comprises a plurality of second net iron wires, a second fixing iron wire and a second moving iron wire; the plurality of first net iron wires are arranged in parallel along a transverse direction and in an aligned manner; the plurality of second net iron wires are arranged in parallel along a transverse direction and in an aligned manner;

one end of each of the plurality of first net iron wires is connected to the first fixing iron wire, and the other end of each of the plurality of first net iron wires is connected to the first moving iron wire; one end of each of the plurality of second net iron wires is connected to the second fixing iron wire, and the other end of each of the plurality of second net iron wires is connected to the second moving iron wire;

the plurality of first net iron wires and the plurality of second net iron wires are staggeredly arranged;

the first moving iron wire is provided with a plurality of first recesses, and the plurality of first recesses respectively fit the plurality of second net iron wires to allow the plurality of second net iron wires to pass through the first moving iron wire to be connected with the second moving iron wire; the second moving iron wire is provided with a plurality of second recesses, and the plurality of second recesses respectively fit the plurality of first net iron wires to allow the plurality of first net iron wires to pass through the second moving iron wire to be connected with the first moving iron wire.

4. The telescopic basket of claim 3, wherein the telescopic basket further comprises a plurality of first flat-head screws and a plurality of second flat-head screws; two ends of the first fixing iron wire are connected to one of the two sets of basket frames respectively through the plurality of first flat screws; two ends of the second fixing iron wire are connected to the other of the two sets of basket frames respectively through the plurality of second flat screws; the fixing part is provided with a third slot configured to fit the first slot; an end of the first moving iron wire passes through the third slot to be connected with an end of the guiding iron wire, and is arranged in the first slot; and an end of the second moving iron wire passes through the third slot to be connected with the end of the guiding iron wire, and is arranged in the first slot.

5. The telescopic basket of claim 4, wherein the basket main body is extendable such that when the basket main body is in an extended position, the positioning frame line of each of the two sets of basket frames is clamped into second slots at an outer side of the connecting part; the guiding iron wire of each of the two sets of basket frames is arranged in the first slot of the connecting part.

6. The telescopic basket of claim 4, wherein the basket main body is contactable such that when the basket main body is in a contracted position, the positioning frame line of each of the two sets of basket frames is clamped into second slots at the middle of the connecting part; the guiding iron wire of each of the two sets of basket frames is arranged in the first slot of the connecting part.

7. The telescopic basket of claim 1, wherein two sides of the basket main body are respectively provided with a hook style slide for installation.

8. The telescopic basket of claim 7, wherein each of the two sets of nets is provided with a first operating part; the hook style slide is provided with a second operating part; and the first operating part is connected with the second operating part.

9. The telescopic basket of claim 1, wherein the connecting part and the fixing part are both made of a plastic.

* * * * *